US005165886A

United States Patent [19]

Frigiere

[11] Patent Number: 5,165,886

[45] Date of Patent: Nov. 24, 1992

[54] CHILDPROOF LIGHTER

[75] Inventor: Rene Frigiere, Charbonnieres les Bains, France

[73] Assignee: Societe Anonyme Cricket, Rillieux-la-Pape, France

[21] Appl. No.: 813,357

[22] Filed: Dec. 24, 1991

[30] Foreign Application Priority Data

Jan. 10, 1991 [FR] France ..... 91 00391

[51] Int. Cl.[5] ..... F23D 11/36

[52] U.S. Cl. ..... 431/254; 431/153; 431/277

[58] Field of Search ..... 431/153, 277, 254, 255; 222/153, 402.11

[56] References Cited

U.S. PATENT DOCUMENTS

| | | | |
|---|---|---|---|
| 4,786,248 | 11/1988 | Nitta | 431/153 X |
| 4,904,180 | 11/1990 | Nitta | 431/153 |
| 5,002,482 | 3/1991 | Fairbanks et al. | 431/277 |
| 5,090,893 | 2/1992 | Floriot | 431/254 X |

OTHER PUBLICATIONS

WO90/00239, Jan. 1990, Ansquer.

*Primary Examiner*—Carl D. Price
*Attorney, Agent, or Firm*—Herbert Dubno; Andrew Wilford

[57] ABSTRACT

A gas lighter has a rocking lever that is pushed down to open a gas-feed valve and/or fire a spark into a jet of gas emitted by the feed valve. A blocking slide on the housing is displaceable transversely between an outer neutralizing position preventing axial downward depression of the lever service end and an inner retracted freeing position permitting the lever service end to be downwardly depressed so that when the blocking slide is in the neutralizing position the lighter cannot be lit. The blocking slide has an outer service end exposed adjacent the lever service end, an inner end engageable axially between the rocking lever and the housing, and a bendable stem extending between the blocking-slide ends. Biasing structure on the housing continuously urges the blocking slide into the blocking position so that the blocking slide must be retained in the freeing position for actuation of the one control means and lighting of the lighter. Inward displacement of the blocking element is resisted such that if a transverse inward force having no significant axially downward component is exerted on the outer blocking-element end the stem will deform and the inner blocking-element end will not move inward, but if the blocking element is displaced by a force having an axial downward component as well as a transverse inward component, the stem will not deform substantially and will push the inner blocking-element end transversely inward.

7 Claims, 4 Drawing Sheets

CHILDPROOF LIGHTER

FIELD OF THE INVENTION

The present invention relates to a cigarette lighter. More particularly this invention concerns such a lighter which is particularly constructed to be childproof, that is not easily operated by a child.

BACKGROUND OF THE INVENTION

In order to prevent a child from having an accident with a cigarette lighter (which term is intended to cover such a device which can be used to light anything) it is standard to provide a latch arrangement that makes it difficult for anyone who does not know not to use the lighter to get a flame out of it. Typically a neutralizing mechanism is employed which must be moved from a blocking to a freeing position in order to be able to operate the standard operating lever or element.

This type of lighter is known in particular from German Utility Model 8,802,582.9. Nonetheless in all these lighters a neutralizing means is not set up so as to be automatically returned to the actuatable neutralizing position after actuation of the igniting mechanism.

In commonly owned patent application 07/651,332 filed Feb. 7, 1991 by Marcel Floriot (now U.S. Pat. No. 5,090,893 issued Feb. 25, 1992) a lighter is described having on which is provided a reservoir containing the gas in liquid form a head comprising in addition to the burner valve connected with the reservoir via a pressure reducer an igniting mechanism comprising control means for opening of the burner valve and means for making sparks and in which associated with the igniting mechanism is means for neutralizing this mechanism and displaceable between an active neutralizing position for the igniting mechanism and a retracted position, these neutralizing means being displaceable manually by the user from their active position to the retracted position. The neutralizing means of the igniting mechanism is normally maintained in the neutralizing position and is in addition set up so as to be automatically returned to the neutralizing position after actuation of the igniting mechanism.

The action to operate such a lighter is not so complex that a clever child cannot figure it out and overcome the childproofing. In fact just holding the device in two hands, as a small child would normally do, will often push in the blocking element enough to allow the sparking lever to be operated.

OBJECTS OF THE INVENTION

It is therefore an object of the present invention to provide an improved childproof lighter.

Another object is the provision of such an improved childproof lighter which overcomes the above-given disadvantages, that is whose childproofing features cannot be overcome readily by a child.

SUMMARY OF THE INVENTION

A gas lighter according to the invention has a housing adapted to hold a supply of combustible gas, a nozzle on the housing adapted to emit a jet of the gas, and a valve control unit including a valve on the housing connected between the nozzle and the supply and actuatable to feed the gas from the supply to the nozzle, a rocking lever having an inner end engaging the valve and an opposite service end intended to be operated by the user by being pushed downward in a direction parallel to an axs toward the housing of the lighter to open the valve, and a return spring braced axially between the lever and the housing and urging the lever service end axially upward. An ignition control unit on the housing adjacent the valve is also actuatable by axial downward depression of the lever service end for forming a spark and igniting the jet therewith. A blocking slide on the housing is displaceable between an outer neutralizing position preventing axial downward depression of the lever service end and an inner retracted freeing position permitting the lever service end to be downwardly depressed so that when the blocking slide is in the neutralizing position the lighter cannot be lit. This slide is positioned under the service end of the rocking lever and can move generally perpendicular to the axis between the outer neutralizing position in which it projects transversely with respect to the service end of the lever and the retracted position in which it is retracted transversely toward the inner end of the rocking lever. The blocking slide has an outer service end exposed adjacent the lever service end, an inner end engageable axially between the rocking lever and the housing, and a bendable stem extending between the blocking-slid ends. Biasing structure on the housing continuously urges the blocking slide into the blocking position so that the blocking slide must be retained in the freeing position for actuation of the one control means and lighting of the lighter. Inward displacement of the blocking element is resisted such that if a transverse inward force having no significant axially downward component is exerted on the outer blocking-element end the stem will deform and the inner blocking-element end will not move inward, but if the blocking element is displaced by a force having an axial downward component as well as a transverse inward component, the stem will not deform substantially and will push the inner blocking-element end transversely inward.

Thus with this invention if, for example, a small child grabs the lighter in one hand and thereby intentionally or inadvertently presses the blocking slide inward, and then operates the rocking lever with the other hand, the lighter will not operate. Only a person dexterous enough to push the slide down and in while simultaneously pushing down the actuating lever can operate it, something fairly easy for an adult to do but virtually impossible for the small thumb of a child.

According to further features of the invention the slide is provided with a guide relative to the housing of the lighter having the shape of a horseshoe having elastic legs carrying a boss normally provided under a skirt bounding the service end of the rocking lever so as to impede rocking thereof in a direction to open the burner valve. Converging complementary flanks are formed on the inside faces of the side walls of the housing of the lighter and on the external faces of the slide to reduce the spacing of their bosses when the slide is moved into the retracted position so as to completely free the path of the skirt of the service end of the rocking lever. The transverse leg of the slide and the rear outside face of the skirt of the service end of the rocking lever have complementary flanks of the same slope that can cooperate with each other when this end of the rocking lever is pushed in to move the slide in the opposite direction into its actuated neutralizing position.

Furthermore according to the invention the housing is formed with a guide pin projecting between the legs of the slide and carrying the return spring of the rocking lever. This pin has a shoulder having a diameter greater than a passage of this spring so as to form an abutment for the spring. The stem extends mainly axially between the blocking-slide ends.

BRIEF DESCRIPTION OF THE DRAWING

The above and other objects, features, and advantages will become more readily apparent from the following, reference being made to the accompanying drawing in which.

SPECIFIC DESCRIPTION

Figure 4:
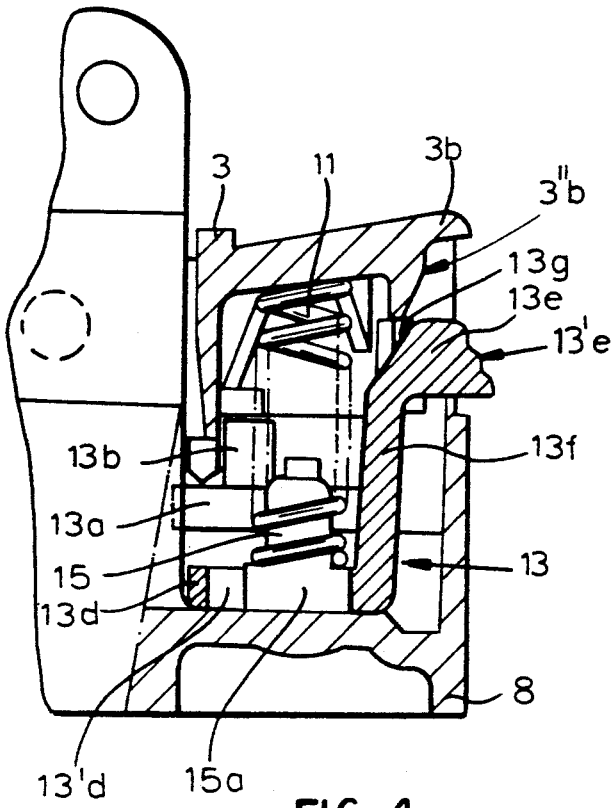
FIGS. 4 and 5 are views like FIGS. 1 and 3, respectively, but showing the lighter in a position in which it can be actuated.

The lighter illustrated in the drawing is a gas lighter having a valve 2 that is operated by a lever 3 pivotal about an axis 4 extending perpendicular to an axis A of the valve 2 and formed by a pair of trunnions 5 formed on the lever 3 and fitted in gudgeon holes 6 formed in side pieces 7 of a body 8 of the lighter. The lever 3 has at its inner end a ring 3*a* that engages under a rim 2*a* of the valve 2 so that when an outer service end 3*b* of the lever 3 is depressed axially downward in the direction of arrow 9 the valve 2 is opened and emits a jet of gas along the valve axis A. A helical spring 11 urges the lever 3 into the unactuated position of FIGS. 1 and 4 that is in a direction opposite the direction 9, thereby closing the valve 2. This spring 11 is interposed between the housing 8 of the lighter and a lower face of the service end 3*b* of the lever 3 and constantly urges this end away from the housing 8 to return the burner valve 2 into the closed position. The end of the spring 11 opposite the actuating end 3*b* of the rocking lever 3 is engaged on a guide and centering pin 15.

An unillustrated flint and a wheel 17 pivoted at 12 on the casing extensions 7 can ignite the gas stream in the manner well known in the art. Thus at the end of actuation of the wheel 17 the thumb of the user falls on the service end 3*b* of the lever 3*b* thus opening the burner valve 2 immediately after the production of sparks, producing a flame.

In this lighter the means for blocking the igniting mechanism is set up to oppose actuation of the rocking lever 3 serving to control opening of the burner valve 2. It is easy to see that if the lever 3 is blocked, even if the spark-making means can be actuated freely, the burner valve 2 cannot be brought to the open position.

Figure 1:
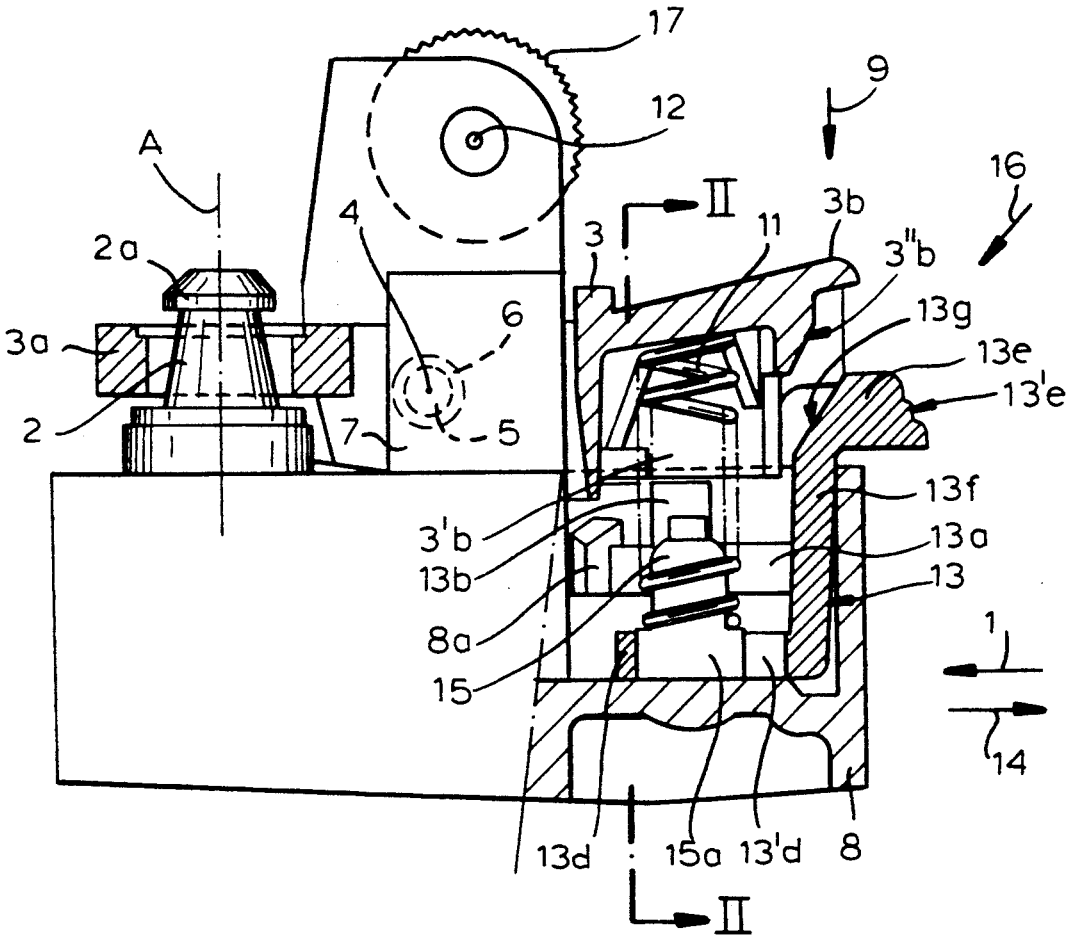
FIG. 1 is a side view partly in vertical section through a lighter according to the invention in the unactuated position.
Figure 2:
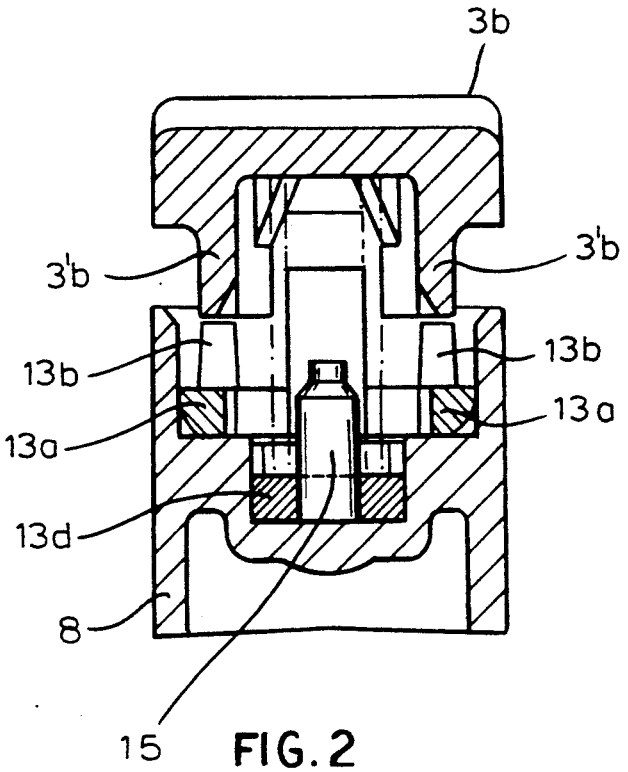
FIG. 2 is a section taken along line II—II of FIG. 1.

The means for neutralizing the igniting mechanism is constituted by a slide 13 whose normal function is to block the lever 3 in a position with the burner valve 2 closed. This slide 13 is moveable perpendicular to the axis A in the two directions illustrated by the arrows 1 and 14, that is toward and away from the burner valve 2 between two end positions of which the one illustrated in FIGS. 1 to 3 is the active neutralizing position for the igniting mechanism, that is the position in which it opposes any movement of the rocking lever 3, while its other end position illustrated in FIGS. 4, 5, and 7 corresponds to the retracted position in which movement of the lever 3 is made possible.

The slide 13 is located under the service end 3*b* of the rocking lever 3. This slide 13 is generally shaped like a horseshoe having a bight 13*c* from which extend elastic side arms 13*a* normally taking the spread position shown in FIG. 3, a position in which their free ends are braced against inside faces 8*a* of the upper ends of the side walls of the housing 8 of this lighter.

Each side arm 13*a* of the slide 13 carries on its upper face a boss or pin 13*b* extending axially upward toward the service end 3*b* of the rocking lever 3 and in the normal position illustrated in FIGS. 1 through 3 these pins 13*b* are just below a skirt 3'*b* which bounds the lower face of the actuating end 3*b* of the rocking lever 3. In this position of the slide 13 any movement of the rocking lever 3 in the direction 9 is thus made impossible. The bight portion 13*c* of the slide 13 carries in addition a central portion 13*d* formed with a longitudinal aperture 13'*d* intended to be engaged around a lower portion 15*a* of the guide pin 15 of the spring 11 below same as shown in particular in FIG. 1. In this regard it is noted that in order to prevent the pressure of the spring 11 from interfering with movement of the slide 13 in the direction of the arrow 1 the pin 15 has at its base a shoulder at least partly of a width corresponding to that of the aperture 13'*d* of the central medial portion 13*d* of the slide 13 but smaller than the central hole or passage of the spring 11. Naturally the height of the shoulder portion 15*a* is at least equal to the thickness of the central portion 13*d* of the slide 13.

Figure 3:
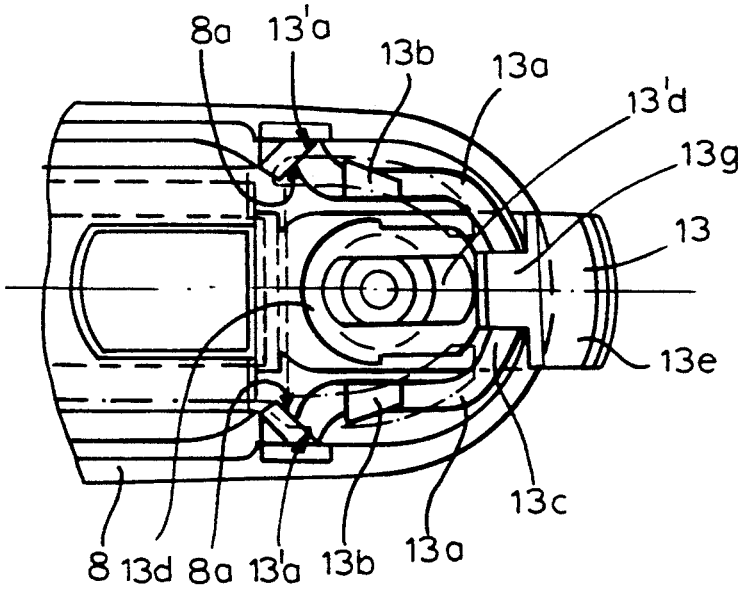
FIG. 3 is a top view of the structure of FIGS. 1 and 2 with some parts removed for clarity of view.
Figure 5:
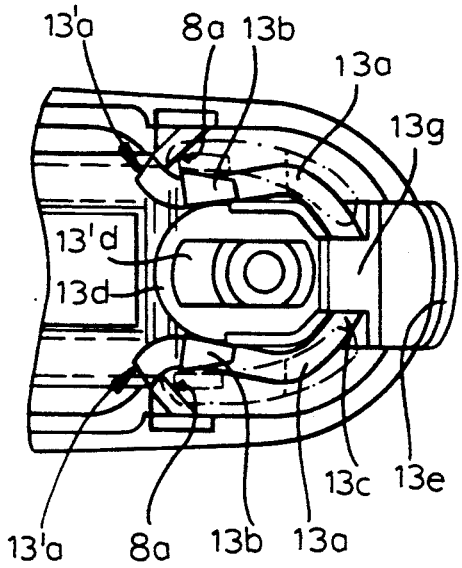

As shown in FIGS. 3 and 5, the free ends of the side arms 13*a* of the slide 13 are bevelled so as to present converging flanks 13'*a* while the side walls of the housing 8 of the lighter have complementary flanks 8*a* against which the flanks 13'*a* of the lateral branches 13*a* of the slide 13 normally engage as shown in FIG. 3.

Figure 7:
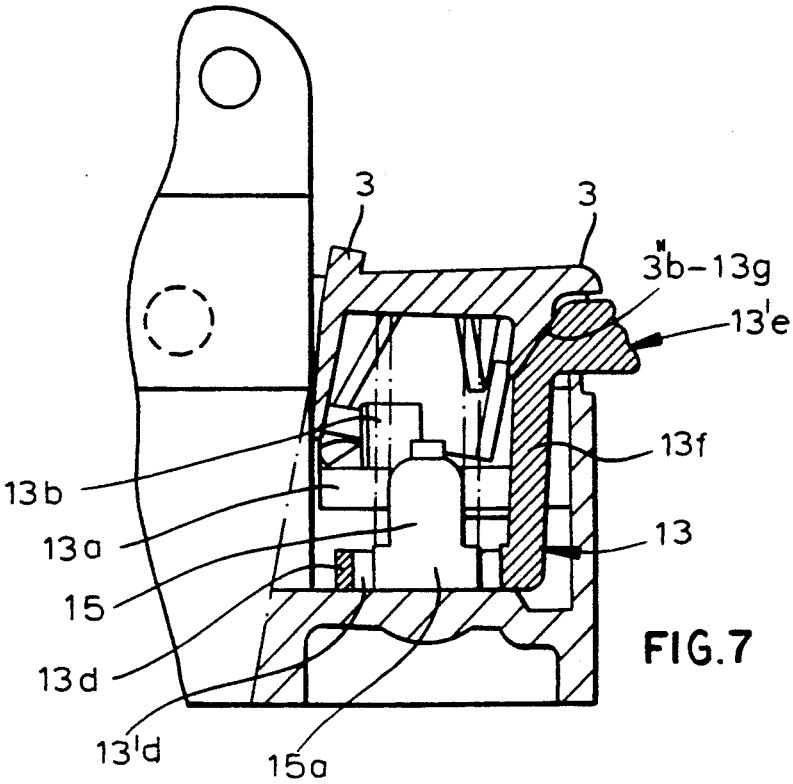
FIG. 7 is a view like FIG. 3 but showing the lighter inthe actuated position.

It is therefore easy to see that movement of the slide 13 by acting on its end 13*b* in the direction of the arrow 16 has the effect of sliding the flanks 13'*a* of these side arms 13*a* along the flanks 8*a* of the walls of the housing 8 of the lighter and of thus provoking a squeezing-together of the arms 13*a* into the approached position shown in FIG. 5, that is in the position in which the free ends of the side arms 13*a* of the slide 13 have gone past the flanks 8*a* of the housing 8 of the lighter. As shown more particularly in FIG. 5, in this position of the slide 13 the bosses 13*b* carried by the side arms 13*a* are moved toward each other to a spacing such that they are no longer in the path of the corresponding parts of the lower skirt 3'*b* of the actuating end 3*b* of the rocking lever 3. This rocking lever 3 can therefore be moved in the direction 9 to control igniting of the lighter as shown in FIG. 7.

FIG. 5 also clearly shows that the slide 13 is retained in the inner unblocking position because the ends of the arms 13*a* move past the surfaces 8*a* and move outward enough to prevent the slide 13 from moving back out. Nonetheless as shown more particularly in FIG. 7, means is provided so that rocking of the rocking lever 3 automatically instigates a return of the slide 13 into its position neutralizing the igniting mechanism, that is blocking the rocking lever 3. In the example illustrated in the drawing this means comprises on the one hand a flank 13*g* extending downward and toward the rear of the bight 13*c* of the slide 13 and a complementary flank 3″*b* formed on the rear and lower edge of the skirt 3′*b* which bounds the lower face of the actuating end 3*b* of the lever 3. In reality the flank 13*g* of the slide 13 is formed on the rear edge of the actuating projection of the slide 13. Thus as shown more particularly in FIG. 7 it is obvious that when the actuating end 3*b* of the rocking lever 3 is moved downward, that is in the direction of arrow 9, its flank 3″*b* coacts with the ramp 13*g* of the slide 13 to displace same in the direction of the arrow 14, that is in the direction opposite that of the arrow 1 to move the inner end surfaces 13′*a* of the a 13*a* outward past the inner ends of the surfaces 8*a*. This displacement takes place obviously only at the end of rocking of the rocking lever 3 in the direction of arrow 9. It is necessary to note that at this instant nothing impedes the displacement of the slide 13 in the direction of the arrow 14 because the bosses 13*b* of the side arms 13*a* of the slide 13 slide against the inside faces of the skirt 3′*b* of the actuating end 3*b* of the rocking lever 3.

The displacement of the slide 13 in the direction of the arrow 14 as a result of the action of the flank 3″*b* of the skirt 3′*b* on the flank 13*g* of the slide 13 is not necessarily sufficient to move the slide 13 all the way into its active neutralizing position illustrated in FIG. 1. In effect, it is enough that this displacement allows the flanks 13′*a* formed at the free ends of these side arms 13*a* to engage the flanks 8*a* of the sides of the housing 8 of the lighter in order that the reciprocal action of the flanks 13′*a* and 8*a* define the end of the travel of the slide 13 in the direction of the arrow 1.

Figure 6:
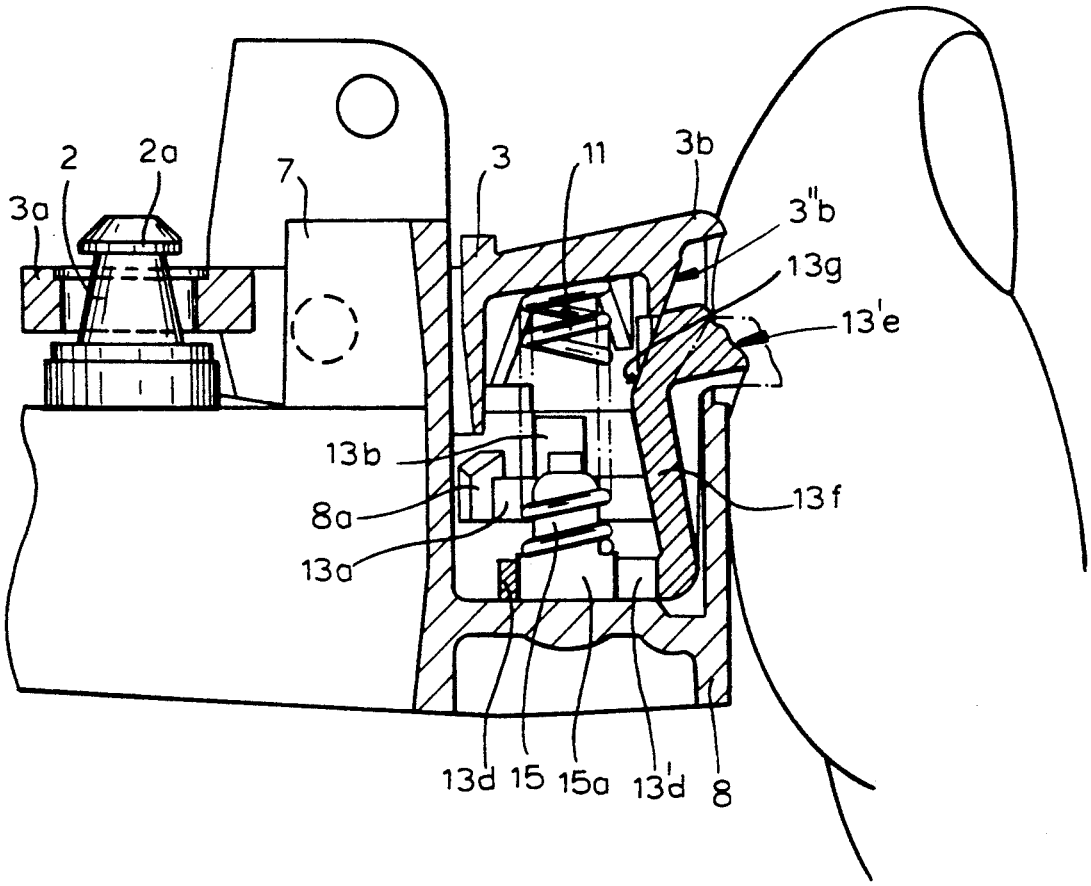
FIG. 6 is a view like FIG. 1 but showing how the lighter remains inoperative when incorrectly operated.

While the above-described structure corresponds closely to that described to the commonly owned above-cited patent application, according to this invention the lighter is constructed so that if the latching slide 13 is not pressed generally in the direction of arrow 16, that is with some downward component to its force, it will not slide in and block actuation of the lever 3. To this end the slide 13 has an actuating or service end 13*e* that is attached by a leg or stem 13*f* to its base part forming the bight 13*c*, arms 13*a*, and portion 13*d* and that can as seen in FIG. 6 be deformed to allow the end 13*e* to be pushed in without getting out of the way of the skirt 3′*b*. This can be done by adjusting the force with which the slide 13 resists movement in the direction 1, changing the length of the stem 13*f*, changing the cross-sectional size and, therefore, the strength of this stem 13*f* in particular at its base, and making the slide 13 or at least its stem 13*f* of a fairly resilient but flexible material.

The force with which the slide 13 resists inward movement is dependent on the flexibility of the arms 13*a*, the angles of the surfaces 8*a* and 13′*a*, and the coefficient of friction between these surfaces. This friction coefficient is easily adjusted by coating the surfaces 8*a* and 13′*a* with a lubricant such as molybdenum disulfide or making them of a low-friction material such as polytetrafluoroethylene or polyoxymethylene, commonly called acetal.

The critical factor is that only a force directed downward and inward as indicated by arrow 16 will move over the slide 13 to unblock the lever 3, thereby allowing the valve 2 to be opened and the unillustrated igniter to be fired. This effect is further aided by forming the service end 13*e* of the slide 13 with an inclined face 13′*e* that is roughly perpendicular to the desired actuation direction 16, that is it slopes outwardly downward, presuming the lighter is in the normal upright position of FIGS. 1, 2, 4, 6, and 7.

I claim:

1. In a gas lighter comprising:

a housing adapted to hold a supply of combustible gas;

a nozzle on the housing adapted to emit a jet of the gas;

valve means including a valve on the housing connected between the nozzle and the supply and actuatable to feed the gas from the supply to the nozzle;

ignition means on the housing adjacent the valve actuatable for forming a spark and igniting the jet therewith;

an actuating element on one end of the housing and having a service end depressible downward toward an opposite end of the housing and parallel to a normally vertical longitudinal axis of the housing and coupled to the valve means for actuating same when depressed downward;

a blocking element on the housing displaceable transversely of the longitudinal axis between an outer blocking position engaging the actuating element and preventing depression thereof and an inner freeing position permitting the actuating element to be depressed, whereby when the blocking element is in the blocking position the lighter cannot be lit;

automatic biasing means operatively engaged between the housing and the blocking element for continuously urging the blocking element into the blocking position, whereby the blocking element must be retained inthe freeing position for depression of the actuating element and lighting of the lighter; and means between the actuating element and the blocking element for automatically returning the blocking element to the blocking position after depression of the actuating element, the improvement wherein the blocking element has an outer service end exposed adjacent the actuating element, an inner end engageable axially between the actuating element and the housing, and a bendable stem extending between the blocking element ends;

the biasing means resists transverse inward displacement of the blocking element such that if a transverse inward force having no significant axially downward component is exerted on the outer blocking-element end the stem will deform and the inner blocking element end will not move inward, but if the blocking element is displaced by a force having an axial downward component as well as a transverse inward component, the stem will not deform substantially and will push the inner blocking-element end transversely inward.

2. The lighter defined in claim 1 wherein the stem extends axially between the blocking-element inner and outer ends.

3. The lighter defined in claim 2 wherein the biasing means includes a surface on the housing and a surface on the blocking element riding on the housing surface and having a predetermined coefficient of friction therewith.

4. A gas lighter comprising:

a housing adapted to hold a supply of combustible gas;

a nozzle on the housing adapted to emit a jet on the gas;

valve control means including a valve on the housing connected between the nozzle and the supply and actuatable to feed the gas from the supply to the nozzle, a rocking lever on one end of the housing having an inner end engaging the valve and an opposite service end intended to be operated by the user by being pushed downward toward an opposite end of the housing and in a direction parallel to a normally vertical longitudinal axis of the housing toward the housing of the lighter to open the valve; and a return spring braced axially between the lever and the housing and urging the lever service end axially upward; 'ignition control means on the housing adjacent the valve actuatable with axial downward depression of the lever service end for forming a spark and igniting the jet therewith;

a blocking slide on the housing displaceable between an outer neutralizing position preventing axial downward depression of the lever service end and an inner retracted freeing position permitting the lever service end to be downwardly depressed, whereby when the blocking slide is in the neutralizing position the lighter cannot be lit, the slide being positioned under the service end of the rocking lever and movable generally perpendicular to the axis between the outer neutralizing position in which it projects transversely as a transverse leg with respect to the service end of the lever and the retracted position in which it is retracted transversely toward the inner end of the rocking lever, the blocking slide having an outer service end exposed adjacent the lever service end, an inner end engageable axially between the rocking lever and the housing, and a bendable stem extending between the blocking-slide ends; and biasing means on the housing for continuously urging the blocking slide into the blocking position, whereby the blocking slide must be retained in the freeing position for actuation of the one control means and lighting of the lighter, the biasing means resisting transverse inward displacement of the blocking element such that if a transverse inward force having no significant axially downward component is exerted on the outer blocking-element end the stem will deform and the inner blocking-element end will not move inward, but if the blocking element is displaced by a force having an axial downward component as well as a transverse inward component, the stem will not deform substantially and will push the inner blocking-element end transversely inward.

5. The gas lighter defined in claim 4 wherein the slide is provided with guide means relative to the housing of the lighter having the shape of a horseshoe having elastic legs carrying a boss normally provided under a skirt bounding the service end of the rocking lever so as to impede rocking thereof in a direction to open the burner valve, converging complementary flanks being formed on the inside faces of the side walls of the housing of the lighter and on the external faces of the slide to reduce the spacing of their bosses when the slide is moved into the retracted position so as to completely free the path of the skirt of the service end of the rocking lever, the transverse leg of the slide and the rear outside face of a skirt of the service end of the rocking lever having complementary flanks of the same slope that can cooperate with each other when this end of the rocking lever is pushed in to move the slide in the opposite direction into its actuated neutralizing position.

6. The gas lighter defined in claim 5 wherein the housing is formed with a guide pin projecting between the legs of the slide and carrying the return spring of the rocking lever, the pin having a shoulder having a diameter greater than a passage of this spring so as to form an abutment for the spring.

7. The gas lighter defined in claim 4 wherein the stem extends mainly axially between the blocking-slide ends.

* * * * *